US005692274A

United States Patent [19]

Merser

[11] Patent Number: 5,692,274

[45] **Date of Patent: *Dec. 2, 1997**

[54] PLASTIC FASTENER FOR SHOE-LASTING APPLICATIONS

[75] Inventor: F. Gerard Merser, Round Pond, Me.

[73] Assignee: Augry Dennison Corporation, Pasadena, Calif.

[ * ] Notice: The term of this patent shall not extend beyond the expiration date of Pat. No. 5,586,353.

[21] Appl. No.: 719,152

[22] Filed: Sep. 24, 1996

Related U.S. Application Data

[63] Continuation of Ser. No. 424,910, Apr. 19, 1995, Pat. No. 5,586,353, which is a continuation of Ser. No. 968,397, Oct. 29, 1992, Pat. No. 5,438,724.

[51] Int. Cl.[6] ..... A43D 9/00; A43D 5/00; B65D 77/10

[52] U.S. Cl. ..... 24/537.1; 24/30.5 P; 12/113; 12/142 LC; 36/50.1

[58] Field of Search ..... 24/573.1, 572.16 PB, 24/30.5 P, 129 A, 712, 713, 713.1, 713.3, 713.4; 12/113, 142 LC; 36/50.1

[56] References Cited

U.S. PATENT DOCUMENTS

| | | | |
|---|---|---|---|
| 760,385 | 5/1904 | Donovan et al. | 12/113 |
| 3,315,324 | 4/1967 | Ward | 24/30.5 P |
| 3,973,610 | 8/1976 | Ballin | 24/30.5 P |
| 4,094,029 | 6/1978 | Carlise | 12/113 |
| 4,466,159 | 8/1984 | Burrage | 24/30.5 P |
| 5,438,724 | 8/1995 | Merser | 12/142 LC |
| 5,465,442 | 11/1995 | Merser | 12/142 LC |
| 5,586,353 | 12/1996 | Merser | 12/142 LC |

FOREIGN PATENT DOCUMENTS

| | | | |
|---|---|---|---|
| 224262 | 11/1958 | Austria | 24/30.5 P |

*Primary Examiner*—Peter M. Cuomo
*Assistant Examiner*—Robert J. Sandy
*Attorney, Agent, or Firm*—Kriegsman & Kriegsman

[57] ABSTRACT

A fastener for tying together a pair of shoelace eyelets on a shoe upper in such a way as to maintain the appropriate spacing therebetween while the shoe upper is being lasted. In one embodiment, the fastener is a unitary plastic member shaped to include an elongated flexible filament having a cross-bar at one end and a paddle at the opposite end, the paddle being provided with two or more alternative openings through which the cross-bar may be inserted to from a loop. The openings are preferably disposed at different points along the length of the paddle so that the different sized loops may be used for different eyelet spacings. In another embodiment, a feed bar is severably connected to the fastener for use in positioning the paddle so that the cross-bar may be aligned with and easily inserted into a desired cross-bar opening. Alternatively, the paddle may be provided with registration means. To attach the fastener to a pair of eyelets of a shoe upper, the paddle is positioned so that a desired opening is aligned with one of the eyelets. The filaments is then drawn over the upper to the other eyelet, and the cross-bar is inserted first through the pair of eyelet and then through the desired opening in the paddle.

6 Claims, 5 Drawing Sheets

PLASTIC FASTENER FOR SHOE-LASTING APPLICATIONS

This is a continuation of U.S. patent application Ser. No. 08/424,910, filed Apr. 19, 1995, now U.S. Pat. No. 5,586,353, which in turn is a continuation of U.S. patent application Ser. No. 07/968,397, filed Oct. 29, 1992, now U.S. Pat. No. 5,438,724.

BACKGROUND OF THE INVENTION

The present invention relates generally to plastic fasteners and more particularly to a plastic fastener that is well-suited for shoe-lasting applications.

Shoe-lasting is a technique commonly employed in the manufacture of footwear for working a shoe upper into its proper form prior to the attachment of a sole thereto. Typically, shoe-lasting comprises placing an unworked shoe upper over a shoe last, i.e., a mandrel having a shape similar to a shoe-tree, and then heating and pulling the shoe upper around the shoe last until the upper conforms generally to the shape of the shoe last.

For shoes of the type that are provided with shoelace eyelets, the above-described technique can pose a problem since the tensioning of the shoe upper around the shoe last can cause the spacing between opposing eyelets on the upper to deviate from what it should be. One approach that has been used to maintain the proper spacing between opposing eyelets on the upper has been to tie together the eyelets with string or the like. Typically, this tying operation is performed with a specifically-designed machine. However, machines of this type have not been made for several years and are, therefore, quite old. In addition, such machines are rather difficult and costly to maintain and use.

Another approach that has been used to maintain the proper spacing between opposing eyelets of a shoe upper during shoe-lasting has been to couple together pairs of opposing eyelets on the upper using plastic fasteners of the type sold by Avery Dennison under the trademark SHD T-End Fasteners. Such fasteners are typically unitary structures each comprising an elongated filament terminating at opposing ends in a cross-bar. To attach the fastener to a shoe upper, one of the cross-bars is inserted through a pair of opposing eyelets on the shoe upper, the other cross-bar not being inserted through either of the eyelets. The cross-bar are appropriately sized so that the fastener cannot easily be pulled through either of the eyelets.

The aforementioned fastener, however, has not been found to be entirely satisfactory in shoe-lasting applications. This is because, where the eyelets of the upper are relatively large compared to the size of the cross-bars, the magnitude of the force used to pull the upper over the shoe-last is often so great as to cause at least one of the cross-bars to be bent inwardly and then pulled through its respective eyelet.

SUMMARY OF THE INVENTION

It is an object of the present invention to provide a new and novel fastener that may be used to tie together a pair of shoelace eyelets of a shoe upper in such a way as to maintain the appropriate spacing between the eyelets while the shoe upper is being lasted.

It is another object of the present invention to provide a fastener as described above that is an improvement over existing such fasteners.

According to one feature of the invention, a fastener is provided which comprises (a) an elongated filament having a first end and a second end, (b) a cross-bar disposed at said first end of said elongated filament, and (c) a paddle disposed at said second end of said elongated filament, said paddle being provided with two or more openings located at different points along the length of said paddle through which said cross-bar may alternatively be inserted to form a loop.

The fastener is preferably a unitary structure made of molded plastic. The paddle may additionally be provided with one or more registration openings which may be used to position the paddle so that the cross-bar may be aligned with and easily inserted through any one of said two or more cross-bar openings. Alternatively, instead of using registration openings to position the paddle, a feed bar connected to the fastener may be used to position the paddle.

It is another object of the present invention to provide a new and novel method for tying together a pair of shoelace eyelets on a shoe upper in such a way as to maintain the appropriate spacing between the eyelets while the shoe upper is being lasted.

Accordingly, it is another feature of the invention to provide a method for tying together a pair of shoelace eyelets on a shoe upper in such a way as to maintain the appropriate spacing between the eyelets while the shoe upper is being lasted which comprises the steps of (a) providing a fastener comprising (i) an elongated filament having a first end and a second end, (ii) a cross-bar disposed at said first end of said elongated filament, and (iii) a paddle disposed at said second end of said elongated filament, said paddle being provided with one or more openings through which said cross-bar may be inserted to form a loop, and (b) inserting said cross-bar first through the pair of shoelace eyelets on the shoe upper and then through one of said one or more openings in said paddle to form a loop.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In drawings wherein like reference numerals represent like parts.

DETAILED DESCRIPTION OF PREFERRED EMBODIMENTS

Figure 1:
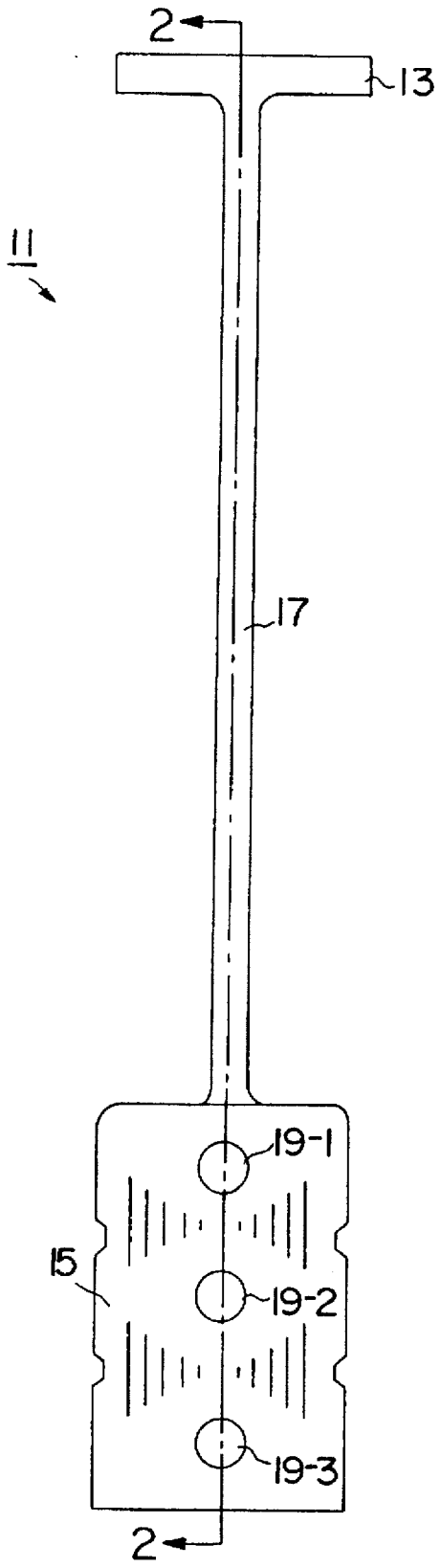
FIG. 1 is a front view of a first embodiment of a fastener constructed according to the teachings of the present invention for tying together a pair of opposing eyelets on a shoe upper in such a way as to maintain the proper spacing therebetween while the shoe upper is being lasted.
Figure 2:
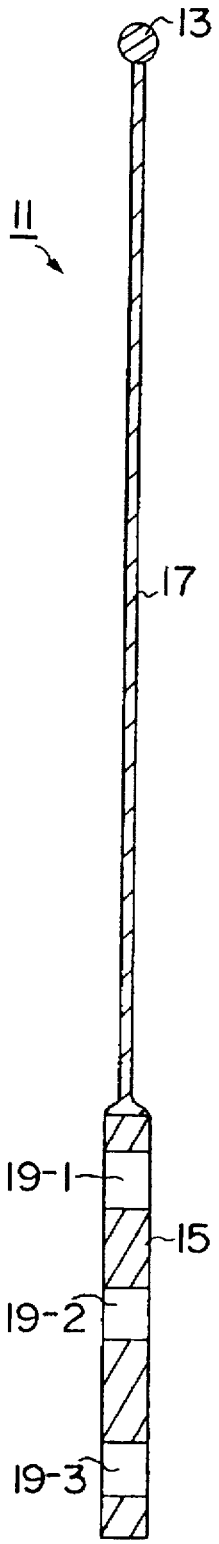
FIG. 2 is a section view of the fastener show in FIG. 1 taken along line A—A.

Referring now to FIGS. 1 and 2, there is shown a first embodiment of a fastener constructed according to the teachings of the present invention for tying together a pair of opposing eyelets on a shoe upper in such a way as to maintain the proper spacing therebetween while the shoe upper is being lasted, the fastener being represented generally by reference numeral 11.

Fastener 11 is unitary plastic member shaped to include a cross-bar 13 at one end, a paddle 15 at the opposite end, and an elongated flexible filament 7 interconnecting cross-bar 13 and paddle 15.

A plurality of openings 19-1 through 19-3 are spaced along the length of paddle 15. As will be discussed below in greater detail, each of openings 19-1 through 19-3 is appropriately sized and shaped so that the ends of fastener 11 may be secured together by inserting cross-bar 13 through one of the openings 19-1 through 19-3 to form a loop. As can readily be appreciated, because openings 19-1 through 19-3 are disposed at different points along the length of paddle 15, eyelets of different spacings can be tied together using fastener 11 merely by inserting cross bar 13 through different openings 19-1 through 19-3. (This is variability of use in fastener 11 obviates the need for different sized filaments 17.)

Fastener 11 may be molded as part of a quantity of continuously connected fastener stock of the type described in either U.S. Pat. No. 3,103,666 or U.S. Pat. No. 4,955,475, both of which are hereby incorporated by reference.

Figure 3:
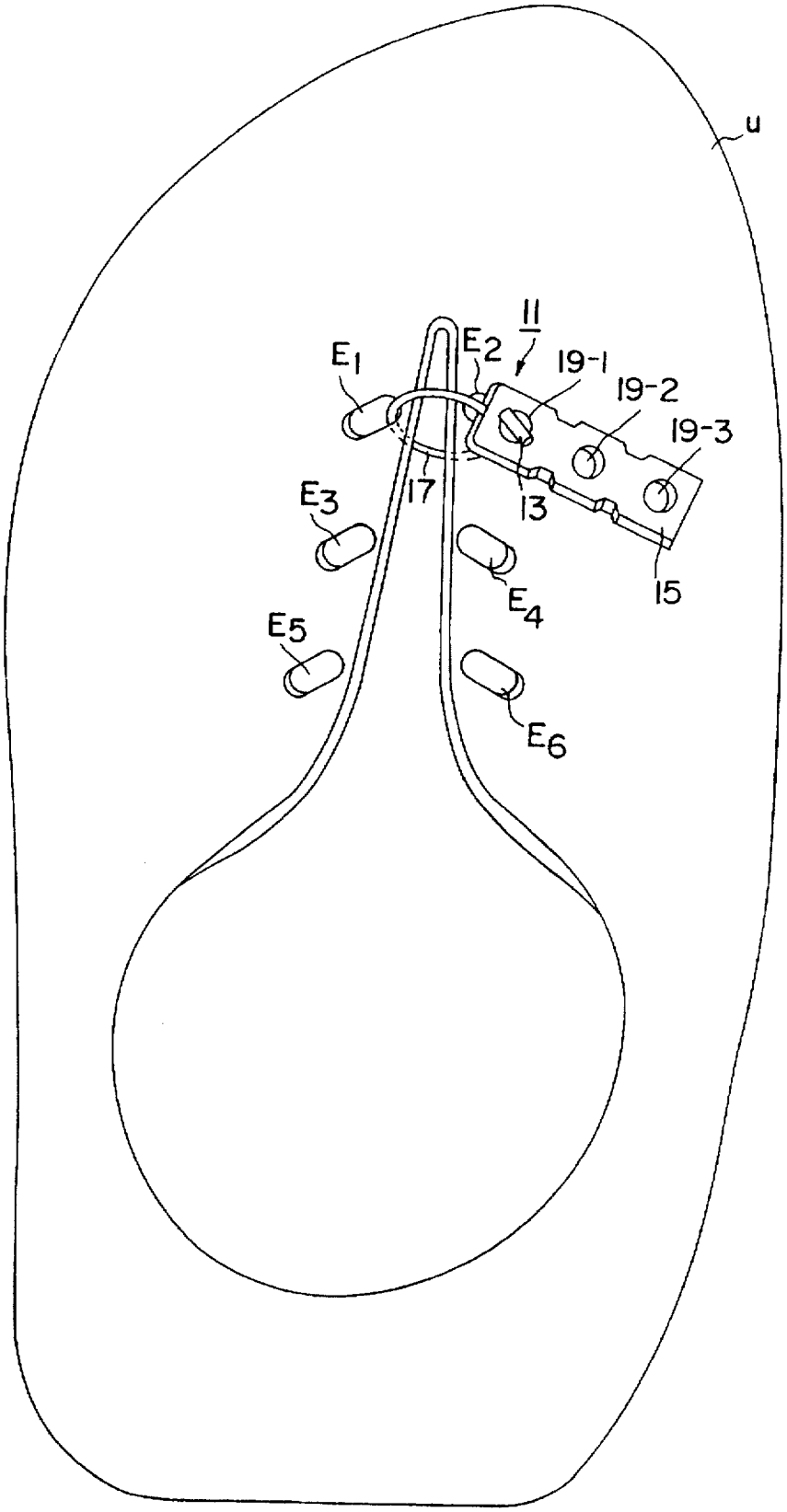
FIG. 3 is a top perspective view illustrating how the fastener of FIG. 1 may be used to tie together a pair of opposing eyelets of a shoe upper in such a way as to maintain the proper spacing therebetween while the shoe upper is being lasted.

Referring now to FIG. 3, the manner in which fastener 11 may be used to tie together a pair of shoelace eyelets $E_1$ and $E_2$ of a shoe upper U in such a way as to maintain the proper spacing therebetween is illustrated. To attach fastener 11 to upper U in the manner shown, paddle 15 is first positioned so that opening 19-1 is aligned with eyelet $E_2$. Filament 17 is then drawn over upper U to eyelet $E_1$, and cross-bar 13 is inserted first through eyelets $E_1$ and $E_2$, respectively, and then through opening 19-1 in paddle 15.

Where the appropriate spacing between a pair of opposing eyelets is greater than that shown for eyelets $E_1$ and $E_2$ (see, for example, in FIG. 3 the spacing between eyelets $E_3$ and $E_4$ and between eyelets $E_5$ and $E_6$), cross-bar 13 may be inserted through either opening 19-2 or opening 19-3 using essentially the same technique as described above. Accordingly, one could use a plurality of identical fasteners 11 to tie together several pairs of differently-spaced eyelets on a single shoe upper by appropriately selecting the opening 19 which results in a loop which most closely conforms to the spacing between the pair of eyelets in question.

Insertion of cross-bar 13 through a pair of opposing eyelets and any one of openings 19-1 thorugh 19-3 may be done manually, with the aid of a conventional tagging gun, or by an automated machine.

After shoe-lasting is completed, fastener 11 may be severed with a knife or the like and then removed from the shoe upper.

In addition to being used in the manner described above to tie together shoelace eyelets of a shoe upper, fastener 11 can also be use to attach tags to articles of commerce, such as sunglasses and handbags, which are difficult to tag using conventional cross-bar and paddle-type fasteners.

Figure 4:
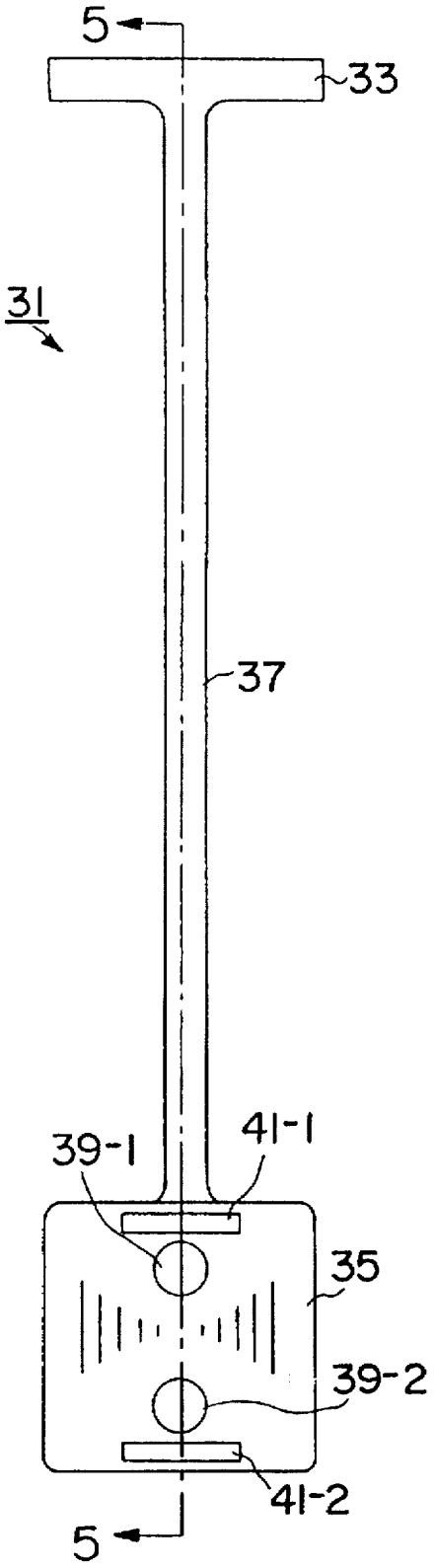
FIG. 4 is a front view of a second embodiment of a fastener constructed according to the teachings of the present invention for tying together a pair of opposing eyelets on a shoe upper in such a way as to maintain the proper spacing therebetween while the shoe upper is being lasted.
Figure 5:
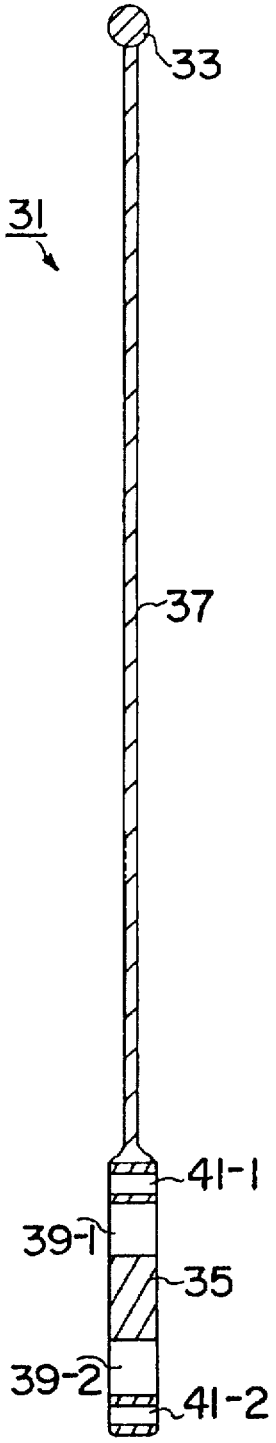
FIG. 5 is a section view of the fastener shown in FIG. 4 taken along line B—B.

Referring now to FIGS. 4 and 5, there is shown a second embodiment of a fastener constructed according to the teachings of the present invention for tying together a pair of opposing eyelets on a shoe upper in such a way as to maintain the appropriate spacing therebetween while the shoe upper is being lasted, the fastener being represented generally by reference numeral 31.

Figure 6:
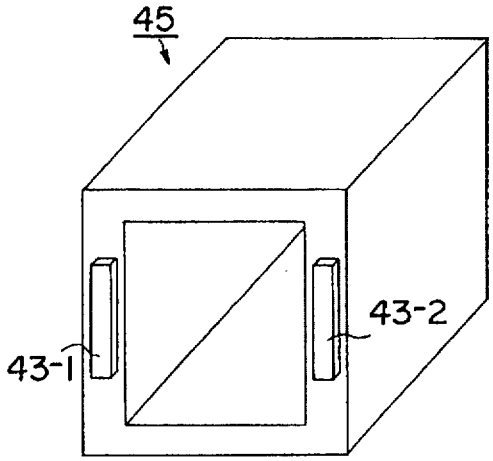
FIG. 6 is a front perspective view of a platen adapted to engage the paddle of the fastener shown in FIG. 5.

Fastener 31 is generally similar in size, shape and construction to fastener 11, fastener 31 also being a unitary plastic member shaped to include a cross-bar 33, a paddle 35 and an elongated flexible filament 37. Fastener 31 differs, however, from fastener 11 in that paddle 35 is provided with a pair of cross-bar openings 39-1 and 39-2 and a pair of registration openings 41-1 and 41-2. Registration openings 41-1 and 41-2, which are adapted to be engaged by a pair of locator probes 43-1 and 43-2, respectively, located on a platen 45 (see FIG. 6), serve to properly position paddle 34 so that cross-bar 33 may be easily aligned with and inserted through either of openings 39-1 and 39-2. Fastener 31 may otherwise be used in the same manner described above in connection with fastener 11.

Fastener 31 may be molded as part of a quantity of continuously connected fasteners stock of the type described in U.S. Pat. Nos. 3,103,666 and 4,955,475.

Figure 7:
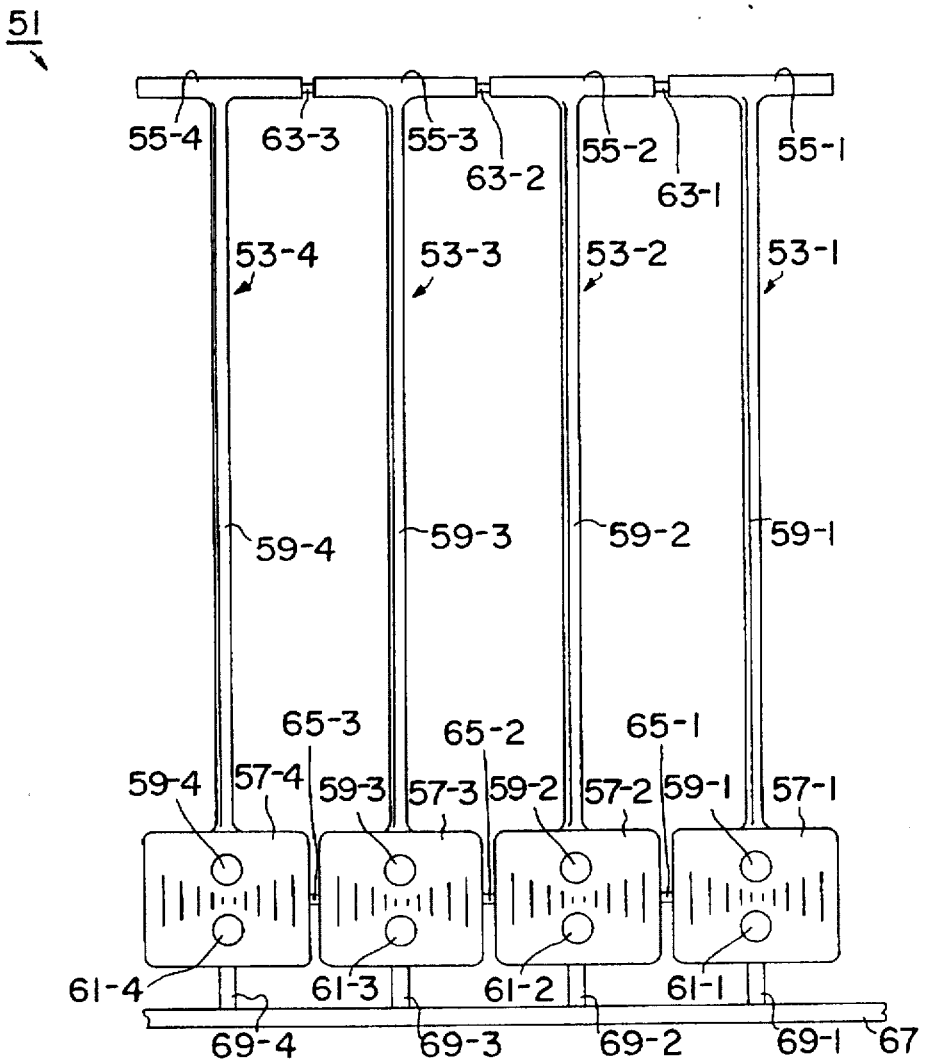
FIG. 7 is a front view of a quantity of continuously connected fastener stock constructed according to the teachings of the present invention, the continuously connected fastener stock including a third embodiment of a fastener for tying together a pair of opposing eyelets on a shoe upper in such a way as to maintain the proper spacing therebetween while the shoe upper is being lasted.

Referring now to FIG. 7, there is shown a quantity of continuously molded plastic fasteners stock constructed according to the teachings of the present invention, the fastener stock being represented generally by reference numeral 51.

Fastener stock 51 includes a plurality of fasteners 53-1 through 53-4, fasteners 53 also being adapted for tying together opposing eyelets on a shoe upper in such a way as to maintain the proper spacing therebetween while the shoe upper is being lasted. Fasteners 53 are generally similar in size, shape and construction to fastener 11, each fastener 53 including a cross-bar 55, a paddle 57, and an elongated flexible filament 59 interconnecting cross-bar 55 and paddle 57. Fasteners 53 differ from fastener 11 in that, for purposes of simplicity and clarity, each paddle 57 includes a pair of cross-bar openings 59 and 61.

Cross-bars 55-1 through 55-4 are joined together by a plurality of severable connectors 63-1 through 63-3, respectively. Paddles 57-1 through 57-4 are joined together by a plurality of severable connectors 65-1 through 65-3, respectively. An elongated feed element 67 is joined to fasteners 53-1 through 53-4 by a plurality of severable connectors 69-1 through 69-4, respectively. The function of feed element 67, which may be handled either manually or by a suitable automated device, is to properly position fasteners 53-1 through 53-4 so that each cross-bar 55 may be easily aligned with and inserted through either opening 59 or opening 61 of its respective paddle 57.

Figure 8:
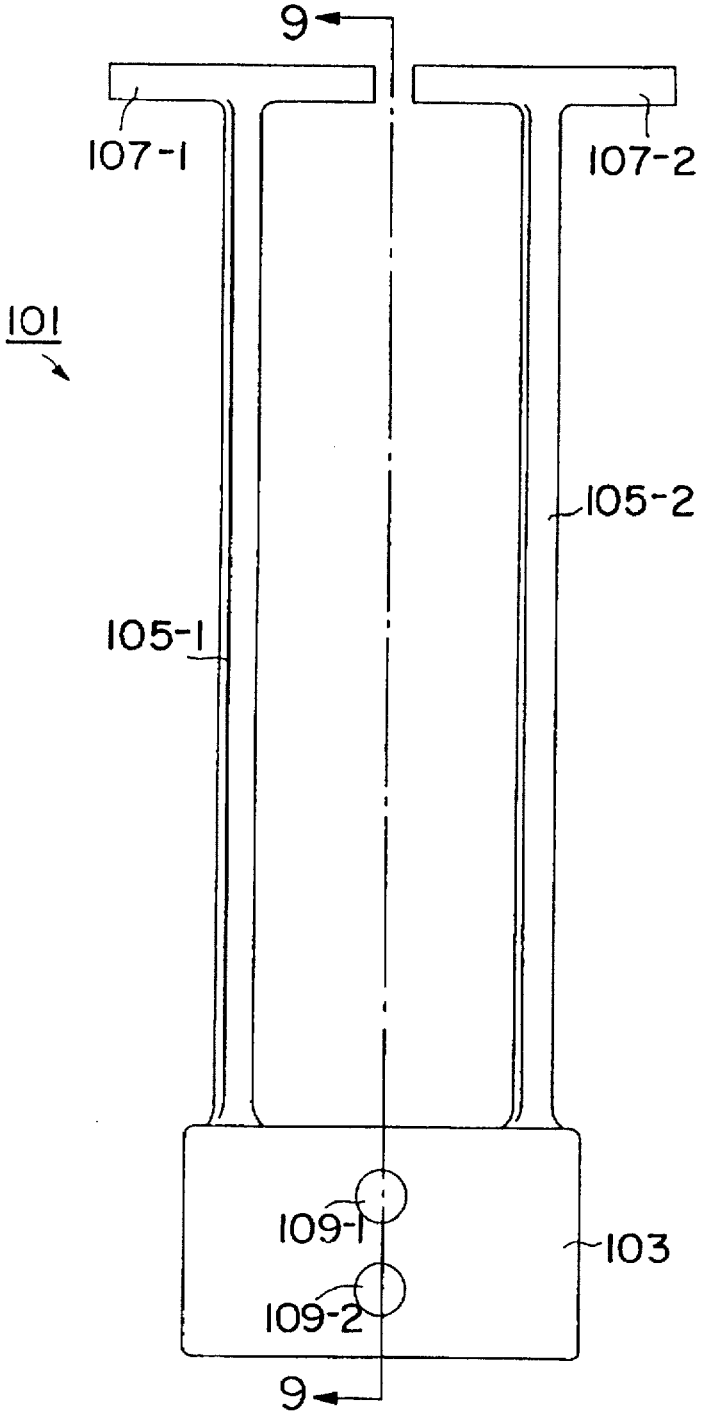
FIG. 8 is a front view of a fourth embodiment of a fastener constructed according to the teachings of a the present invention for tying together a pair of opposing eyelets on a shoe upper in such a way as to maintain the proper spacing therebetween while the shoe upper is being lasted.
Figure 9:
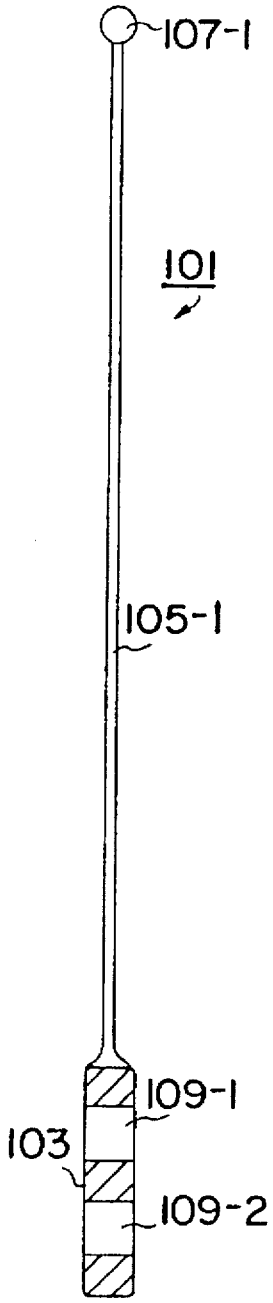
FIG. 9 is a section view of the fastener shown in FIG. 8 taken along line C—C.

Referring now to FIGS. 8 and 9, there is shown a fourth embodiment of a fastener constructed according to the teachings of the present invention for tying together a pair of opposing eyelets on a shoe upper in such a way as to maintain the proper spacing therebetween while the shoe upper is being lasted, the fastener being represented generally by reference number 101.

Fastener 101 is a unitary plastic member shaped to include a paddle 103, a pair of elongated flexible filaments 105-1 and 105-2, and a pair of cross-bars 107-1 and 107-2. A pair of cross-bar openings 109-1 and 109-2 are spaced along the length of paddle 103, each of openings 109-1 and 109-2 being adapted to receive one or both of cross-bars 107-1 and 107-2.

Fastener 101 may be molded as part of a quantity of continuously connected fastener stock of the type described in U.S. Pat. Nos. 3,103,666 and 4,955,475.

Fastener 101 may be used in essentially the same way as fastener 11, with one or both of cross-bars 107-1 and 107-2 being inserted through either of openings 109-1 and 109-2 of paddle 103. As can readily be appreciated, insertion of both cross-bars 107, as opposed to a single cross-bar, through one of openings 109 increases the binding strength of fastener 101.

The embodiments of the present invention recited herein are intended to be merely exemplary and those skilled in the art will be able to make numerous variations and modifications to it without departing from the spirit of the present invention. For example, it is considered to be within the skill of those of ordinary skill in the art to combine selected features of the embodiments described above in various different ways. All such variations and modifications are intended to be within the scope of the present invention as defined by the claims appended hereto.

What is claimed is:

1. A fastener comprising:

(a) an elongated flexible filament having a first end and a second end;

(b) a cross-bar disposed at said first end of said elongated flexible filament, said cross-bar having a pair of ends; and (c) a paddle disposed at said second end of said elongated flexible filament, said paddle being provided with at least two alternative openings through either one of which said cross-bar may be axially and completely inserted to form a rounded loop, wherein at least two of said alternative openings are arranged generally parallel to the longitudinal axis of said elongated flexible filament so that different sized loops may be formed.

2. The fastener as claimed in claim 1 wherein said alternative openings are of similar shape.

3. The fastener as claimed in claim 2 wherein each of said alternative openings is generally circular in shape.

4. A fastener for tying together a pair of shoelace eyelets of a shoe upper for use during shoe-lasting, said fastener comprising:

(a) a single elongated flexible filament having a first end and a second end;

(b) a cross-bar disposed at said first end of said single elongated flexible filament, said cross-bar having a pair of ends; and (c) a paddle disposed at said second end of said single elongated flexible filament, said paddle being wider and shorter than said single elongated flexible filament and being provided with at least two alternative openings through either one of which said cross-bar may be axially and completely inserted to form a rounded loop, wherein at least two of said alternative openings are arranged generally parallel to the longitudinal axis of said single elongated flexible filament so that different sized loops may be formed.

5. The fastener as claimed in claim 4 wherein said alternative openings are of similar shape.

6. The fastener as claimed in claim 5 wherein each of said alternative openings are generally circular in shape.

* * * * *